US006867641B2

(12) United States Patent
Kang et al.

(10) Patent No.: US 6,867,641 B2
(45) Date of Patent: Mar. 15, 2005

(54) INTERNAL VOLTAGE GENERATOR FOR SEMICONDUCTOR DEVICE

(75) Inventors: Chang Seok Kang, Kyoungki-do (KR); Jun Gi Choi, Kyoungki-do (KR)

(73) Assignee: Hynix Semiconductor Inc., Kyoungki-do (KR)

( * ) Notice: Subject to any disclaimer, the term of this patent is extended or adjusted under 35 U.S.C. 154(b) by 4 days.

(21) Appl. No.: 10/671,382

(22) Filed: Sep. 25, 2003

(65) Prior Publication Data

US 2004/0263142 A1 Dec. 30, 2004

(30) Foreign Application Priority Data

Jun. 16, 2003 (KR) ..... 10-2003-0038744

(51) Int. Cl.[7] ..... G05F 1/10; G03G 3/16

(52) U.S. Cl. ..... 327/541; 327/543; 327/538; 327/540

(58) Field of Search ..... 327/538, 540, 327/541, 543

(56) References Cited

U.S. PATENT DOCUMENTS 5,491,437 A * 2/1996 Rincon et al. ..... 327/108
6,288,967 B2 * 9/2001 Fujisawa et al. ..... 365/226
6,477,090 B2 * 11/2002 Yamaki et al. ..... 365/189.09
6,643,193 B2 * 11/2003 Yamaki et al. ..... 365/189.09
6,720,755 B1 * 4/2004 Sharpe-Geisler ..... 323/314
6,734,719 B2 * 5/2004 Tanzawa et al. ..... 327/541
6,774,712 B2 * 8/2004 Rhee et al. ..... 327/540

* cited by examiner

*Primary Examiner*—Bao Q. Vu
(74) *Attorney, Agent, or Firm*—Ladas & Parry LLP

(57) ABSTRACT

Disclosed is an internal voltage generator which generates a stable internal voltage using two power up sensing means. Clamp means outputs a first voltage. First and second power up sensing means sense the external applied to the semiconductor device and output first and second control signals, respectively. A first switch receives the first voltage and a switch controller receives the first and second control signals from the first and second power up sensing means and controls turn on/off of the first switch. A second switch is turned on/off according to the second control signal from the second power up sensing means and receives a second voltage. An amplifier selectively receives the first and second voltages from the first and second switches and outputs the second voltage.

6 Claims, 7 Drawing Sheets

INTERNAL VOLTAGE GENERATOR FOR SEMICONDUCTOR DEVICE

BACKGROUND OF THE INVENTION

1. Field of the Invention

The present invention relates to an internal voltage generator for a semiconductor device, and more particularly to an apparatus for generating an internal voltage used to drive an internal circuit of the semiconductor device after applying an external voltage. Preferably, the present invention relates to an internal voltage generator for the semiconductor device which generates a stable internal voltage, even if a level of an external voltage is lower than a normal level.

2. Description of the Prior Art

As generally known in the art, an external voltage is applied to a semiconductor device but is not directly used in an internal circuit of the semiconductor device. The first reason is that the internal circuit of the semiconductor device is wrongly operated when directly applying the external voltage to the internal circuit. The second reason is that the potential level is unstable because the external voltage is entered together with a noise.

Due to the above reasons, after the external voltage applied to the semiconductor device passes through an internal buffer, it is generally used as an internal voltage. However, internal voltages used in a semiconductor device have generally various potential levels according to the features of an internal circuit for the semiconductor device.

Such internal voltages do not have significant problems when an external voltage has a normal potential level. However, when the level of the external voltage changes, the internal voltage changes under the influence thereof. In particular, when the internal voltage is unstable, the possibility of an erroneous operation of an internal circuit in the semiconductor device increases. The internal circuit uses the internal voltage as a driving voltage.

Hereinafter, a conventional internal voltage generator for a semiconductor device will be explained with reference to FIGS. 1A, 1B, and 1C.

In general, a semiconductor memory device is divided into a core area and a peripheral area thereof. The core area has a memory cell area. The peripheral area has a driver and an internal voltage generator. The driver drives the core area. Each of the core voltage generators shown in FIGS. 1B and 1C is installed in the peripheral area of a semiconductor memory device, and generates an internal voltage for driving the core area having a memory cell area.

FIG. 1A shows a power up sensing circuit which senses an external voltage applied to a semiconductor memory device. When an external voltage VDD is applied to the semiconductor memory device at the early stage of the operation, an output (pwrup) voltage of the power up sensing circuit is at a low level. When a predetermined time lapses, the output (pwrup) voltage of the power up sensing circuit becomes a high level. Although it is shown in FIG. 2, the output voltage pwrup of the power up sensing circuit having a high level depends upon the level of the external voltage.

FIG. 1B shows a core voltage generator operating before the output voltage pwrup of the power up sensing circuit reaches a high level.

As shown in FIG. 1B, when the output (pwrup) voltage of the power up sensing circuit is at a low level (ground voltage), the level of the core voltage is nearly identical with that of the external voltage VDD.

FIG. 1C shows a core voltage generator operating when the output (pwrup) voltage of the power up sensing circuit becomes a high level. Such a core voltage generator is well-known and details thereof will thus be omitted. When the core voltage generator of FIG. 1C operates, the power up sensing circuit of FIG. 1B does not operate.

In a normal operation of the core voltage generator shown in FIG. 1C, when a reference voltage vro_bandgap is applied to the core voltage generator, an output voltage VCORE has twice the reference voltage. For example, in a semiconductor memory device for receiving an external voltage of 2.5 V, the core voltage is set to about 1.8 V. Accordingly, the reference voltage vro_bandgap applied to the core voltage generator shown in FIG. 1C is about 0.9 V.

FIG. 2A illustrates a direct current voltage waveform of the conventional circuits shown in FIGS. 1A, 1B and 1C.

As shown in FIG. 2A, when an output voltage pwrup of the power up sensing circuit is at a low level (that is, before it changes to a high level), a circuit shown in FIG. 1C operates to output a core voltage VCORE having twice the reference voltage vro_bandgap. When the external voltage VDD exceeds 2.0V, the core voltage generator of FIG. 1C outputs a core voltage VCORE of 1.8 V which is a destination value thereof.

However, in FIG. 2A, after an output voltage pwrup of the power up sensing circuit changes from a low level to a high level, the core voltage VCORE is unstable for a predetermined time. The reason is that the core voltage generator of FIG. 1C does not respond to a change of the output of the power up when it suddenly changes. As apparent from the encircled portion, when the output voltage pwrup of the power up sensing circuit changes from a low level to a high level, degradation of the core voltage occurs. In order to test the semiconductor memory, when an external voltage less than 2.0 V is applied to a semiconductor memory device having an external standard voltage of 2.5 V due to noise, the internal circuit of the semiconductor memory device operates erroneously due to the change of the core voltage VCORE. The internal circuit of the semiconductor device operates by the core voltage VCORE and the core voltage VCORE is an internal voltage.

FIG. 2B illustrates an alternating current voltage waveform of the circuits shown in FIGS. 1A, 1B and 1C. When the external voltage VDD changes, a degration of the core voltage VCORE is great. The core voltage VCORE is used for the internal voltage.

SUMMARY OF THE INVENTION

Accordingly, the present invention has been made to solve the above-mentioned problems occurring in the prior art, and the object of the present invention is to provide an internal voltage generator which generates a stable internal voltage using two power up sensing circuits.

It is another object to provide a core voltage generator for a semiconductor memory device generates a core voltage being an internal voltage using an output voltage of a first power up sensing circuit in a first stage, generates a core voltage using a second power; up sensing circuit for a predetermined time after the output voltage of the first power up sensing circuit changes to a high level, and generates a core voltage having twice a reference voltage applied to a core voltage generator after the output voltage of the second power up sensing circuit changes to the high level.

In order to achieve the object, the present invention provides an internal voltage generator for a semiconductor device, for receiving first through third control signals and generating an internal voltage used in the semiconductor device when applying an external voltage to the semiconductor device.

The internal voltage used in the semiconductor is a first voltage until a first control signal becomes equal to the external voltage applied to the semiconductor device. The internal voltage used in the semiconductor is a second voltage until a second control voltage becomes equal to the external voltage after the first control signal becomes equal to the external voltage. After both of the first and second control signals become equal to the external voltage, the internal voltage used in the semiconductor is a third voltage, the first voltage is less than the second voltage, and the second voltage is less than or equal to the third voltage. A level of the first voltage depends upon a level of the external voltage, and a level of the third voltage is fixed.

There is also provided an internal voltage generator for receiving an external voltage and outputting an internal voltage, the internal voltage generator comprising: a clamp circuit for outputting a first voltage; first and second power up sensing circuits for sensing the external applied to the semiconductor device and outputting first and second control signals; a first switch for receiving the first voltage; a switch controller for receiving the first and second control signals from the first and second power up sensing circuits and controlling turn on/off of the first switch; a second switch being turned on/off according to the second control signal from the second power up sensing circuit for receiving a second voltage; and an amplifier for selectively receiving the first and second voltages from the first and second switches and outputting the second voltage.

BRIEF DESCRIPTION OF THE DRAWINGS

The above and other objects, features and advantages of he present invention will be more apparent from the following detailed description taken in conjunction with the accompanying drawings, in which.

DETAILED DESCRIPTION OF THE PREFERRED EMBODIMENTS

Figure 1A:
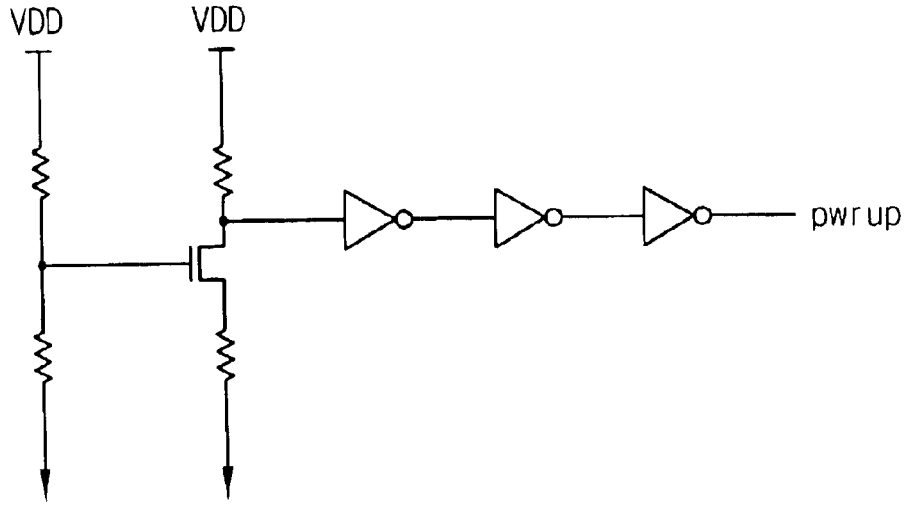
FIG. 1A (RELATED ART)
FIGS. 1A, 1B, and 1C are circuitry diagrams showing conventional internal voltage generators for a semiconductor device.
Figure 1B:
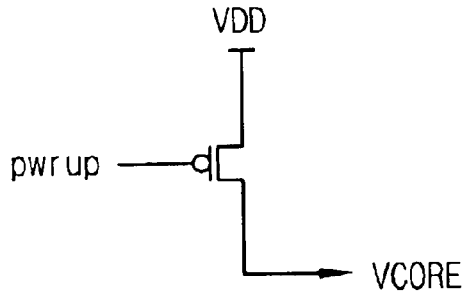
FIG. 1B (RELATED ART)
Figure 1C:
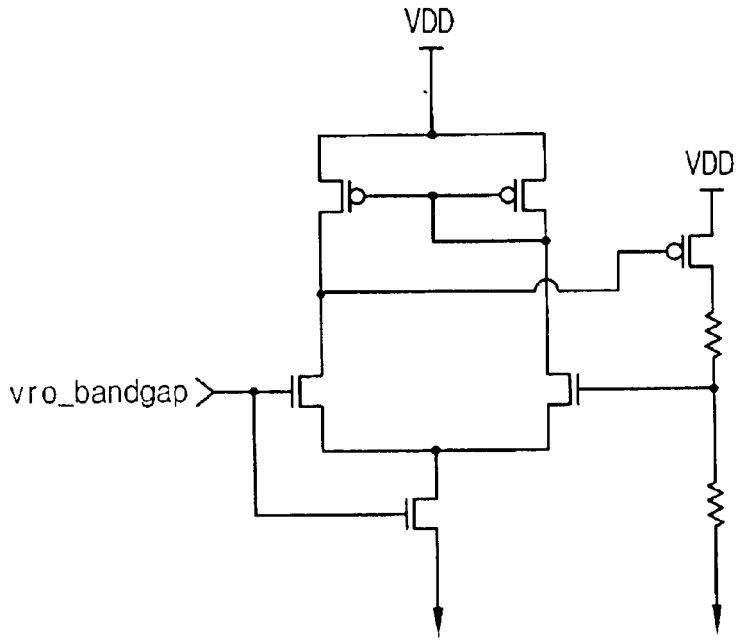
FIG.1C (RELATED ART)

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 3A:
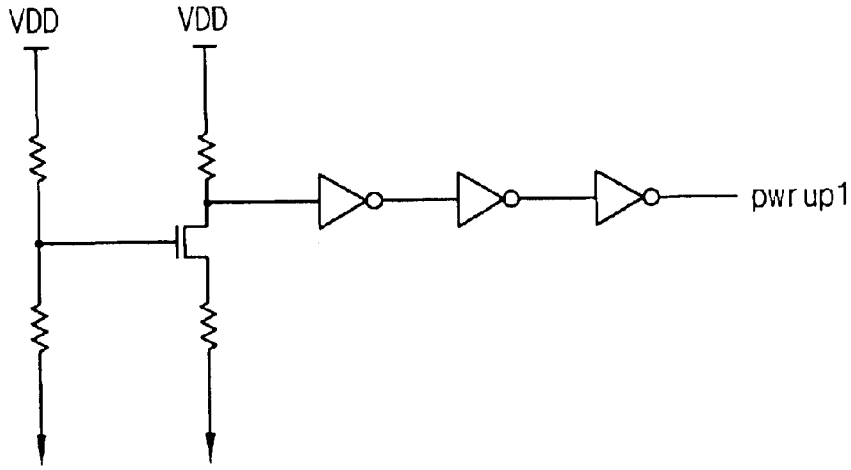
FIG. 3A is a circuitry diagram for showing a first power up sensing circuit according to an embodiment of the present invention.

FIG. 3A is a circuitry diagram for showing a first power up sensing circuit according to an embodiment of the present invention. A fundamental configulation of the first power up sensing circuit is identical with that of a cicruit shown in FIG. 1A.

In the operation, when an external voltage VDD is applied to the first power up sensing circuit, an NMOS transistor maintains a turn-off state, so that an output voltage pwrup1 of the first power up sensing circuit is at a low level. When a predetermined time elapses, the NMOS transistor is turned on, so that the output voltage pwrup1 of the first power up sensing circuit becomes a high level.

Figure 3B:
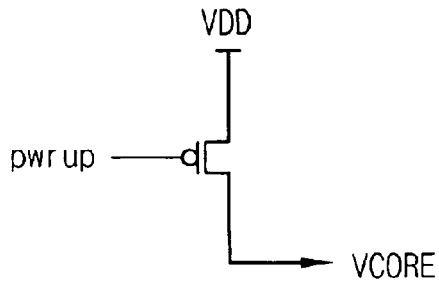
FIG. 3B is a circuitry diagram for showing a core voltage generator operating before an output voltage of the first power up sensing circuit shown in FIG. 3A.

FIG. 3B is a circuitry diagram for showing a core voltage generator operating before an output voltage of the first power up sensing circuit shown in FIG. 3A.

In the operation, when the output voltage pwrup1 of the first power up sensing circuit is at a low level, a PMOS transistor is in a turn-on state. Accordingly, a core voltage VCORE is used for a driving voltage of the internal circuit of the semiconductor memory device depending upon a level of the external voltage VDD.

Figure 3C:
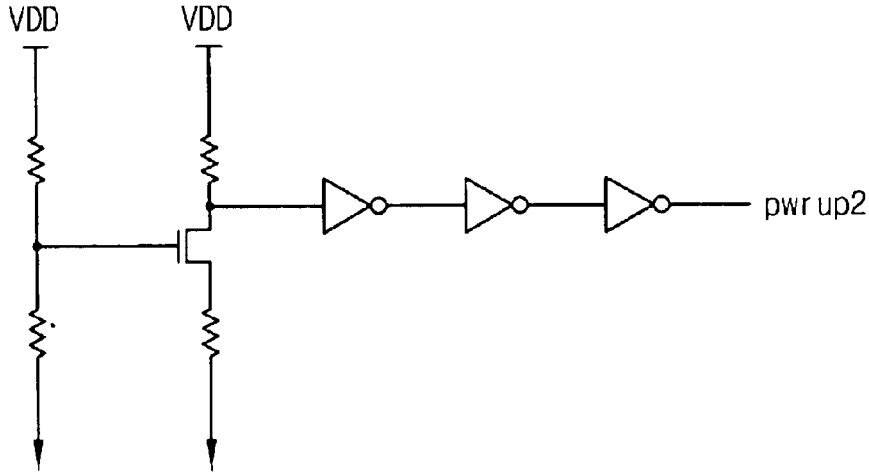
FIG. 3C is a circuitry diagram for showing a second power up sensing circuit according to an embodiment of the present invention.

FIG. 3C is a circuitry diagram for showing a second power up sensing circuit according to an embodiment of the present invention. A fundamental configuration of the second power up sensing circuit is identical with that of the first power up sensing circuit shown in FIG. 3A. However, a delay time of an inverter chain of FIG. 3C is designed to have a greater delay time than an inverter chain of FIG. 3A. Accordingly, after the external voltage VDD is applied to the second power up sensing circuit, the change time of the output voltage pwrup2 of the second power up sensing circuit from a low level to a high level is greater than that of the output voltage pwrup2 of the first power up sensing circuit. As shown in FIG. 3C, the output signal pwrup2 of the second power up sensing circuit is used as an input signal of the circuit shown in FIG. 4.

Figure 4:
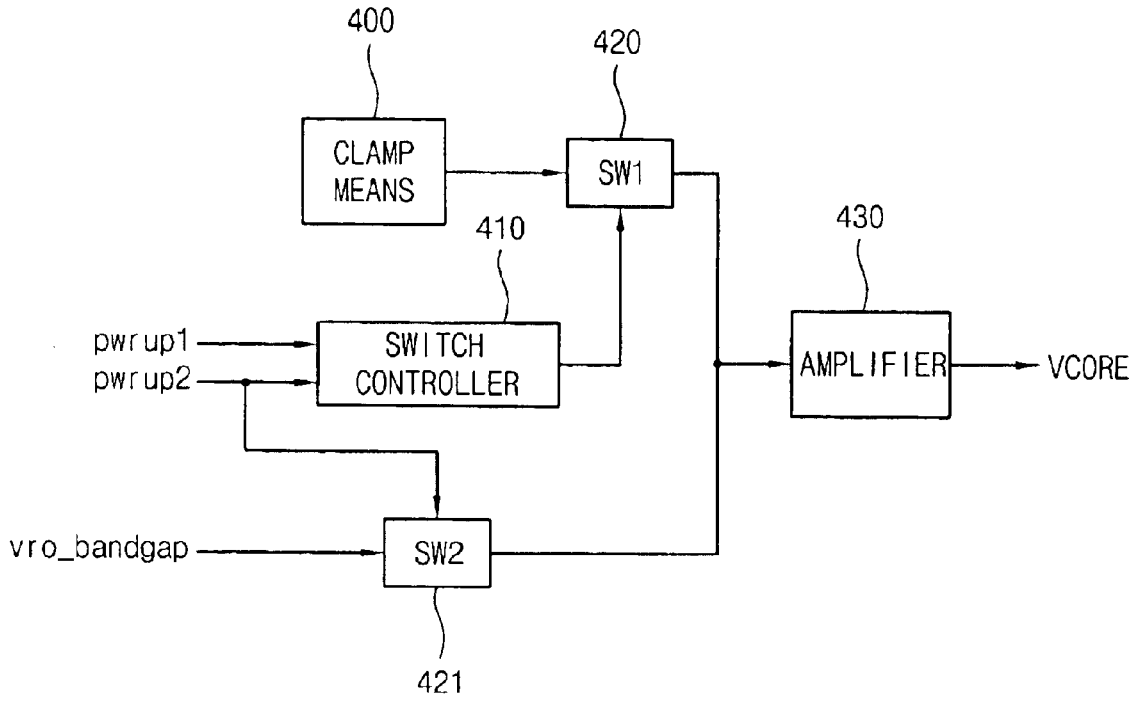
FIG. 4 is a circuitry diagram for showing an internal voltage generator according to an embodiment of the present invention.

FIG. 4 is a circuitry diagram for showing an internal voltage generator according to an embodiment of the present invention. The internal voltage generator generates a driving voltage for driving a core area. The core area is a memory cell array area of a semiconductor memory device.

As shown in FIG. 4, the core voltage generator includes a clamp circuit 400, a switch controller 410, a first switch 420, a second switch 421, and an amplifier 430.

The clamp circuit 400 clamps a predetermined voltage and output the clamped voltage. The switch controller 410 receives output voltages pwrup1 and pwrup2 of the first and second power up sensing circuits. The first switch 420 is turned on/off under a control of the switch controller. The second switch 421 is turned on/off according to the output voltage pwrup2 of the second power up sensing circuit and transfers a predetermined reference voltage vro_bandgap. The amplifier 430 amplifies a predetermined voltage transferred through switches 420 and 421 and outputs a core voltage.

Figure 5:
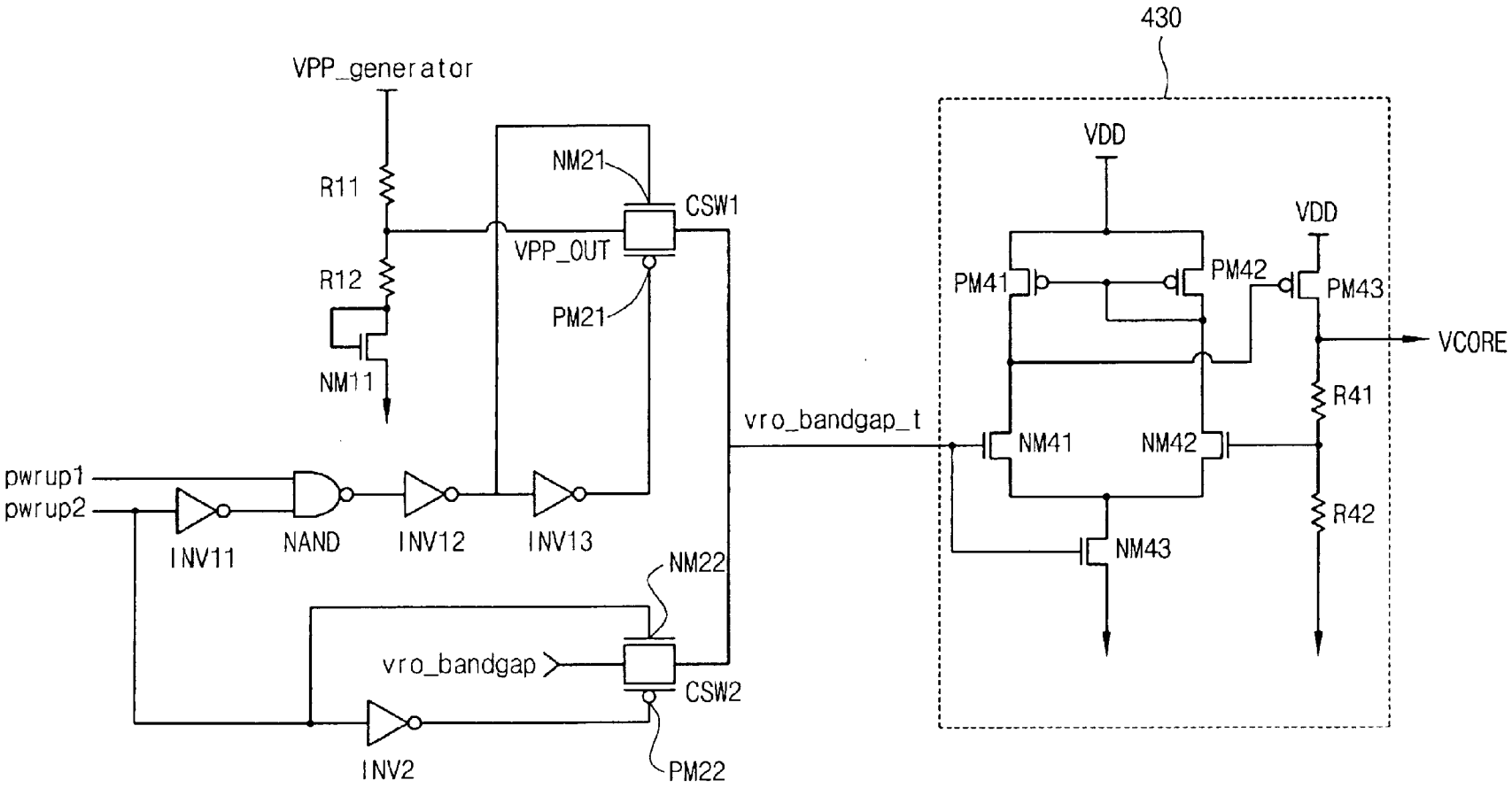
FIG. 5 is a circuitry diagram for showing details of the internal voltage generator shown in FIG. 4.

FIG. 5 is a circuitry diagram for showing details of the internal voltage generator shown in FIG. 4.

As shown in FIG. 5, the clamp circuit 400 includes resistors R11 and R12, and an NMOS transistor NM11. The resistors R11 and R12 are connected between a supply voltage VPP and a ground voltage to each other in series. A drain and a gate of the NMOS transistor NM11 are connected to each other. The supply voltage VPP is one example of the internal voltage. In general, during an active operation, an internal voltage having a level greater than a level of the external voltage VDD is preferably selected as the supply voltage of the clamp circuit 400. An output voltage VPP_OUT of the clamp circuit 400 is a node voltage between the resistors R11 and R12. Preferably, the output voltage VPP_OUT of the clamp circuit 400 is designed to be a half of a final core voltage VCORE which is an internal voltage outputted from the amplifier 430.

As shown in FIG. 5, immediately after the external voltage VDD is applied, an initial value of the output voltage VPP_OUT of the clamp circuit 400 may be less than a half of the final core voltage VCORE for a predetermined time. The reason is that a supply voltage VPP is not normally supplied for a predetermined time after the external voltage VDD is applied to the clamp circuit 400.

The switch controller 410 includes a first inverter INV11, a NAND gate NAND, a second inverter INV12, and a third inverter INV13. The first inverter INV1 inverts the output voltage pwrup2 of the second power up sensing circuit and outputs an inverted signal. The NAND gate NAND NANDs the output voltage pwrup1 of the first power up sensing circuit and the inverted signal from the first inverter INV1. The second inverter INV12 inverts an output signal of the NAND gate NAND. The third inverter INV13 inverts an output signal of the second inverter INV2.

The first switch 420 includes a transfer gate which is formed by a PMOS transistor PM21 and an NMOS transistor NM21. A gate of the PMOS transistor PM21 is connected to an output terminal of the third inverter INV3. A gate of the NMOS transistor NM21 is connected to an output terminal of the second inverter INV12. When the first switch 420 turns on, the output signal VPP_UT of the clamp circuit 400 is transferred to an input terminal of the amplifier 430.

Figure 6:
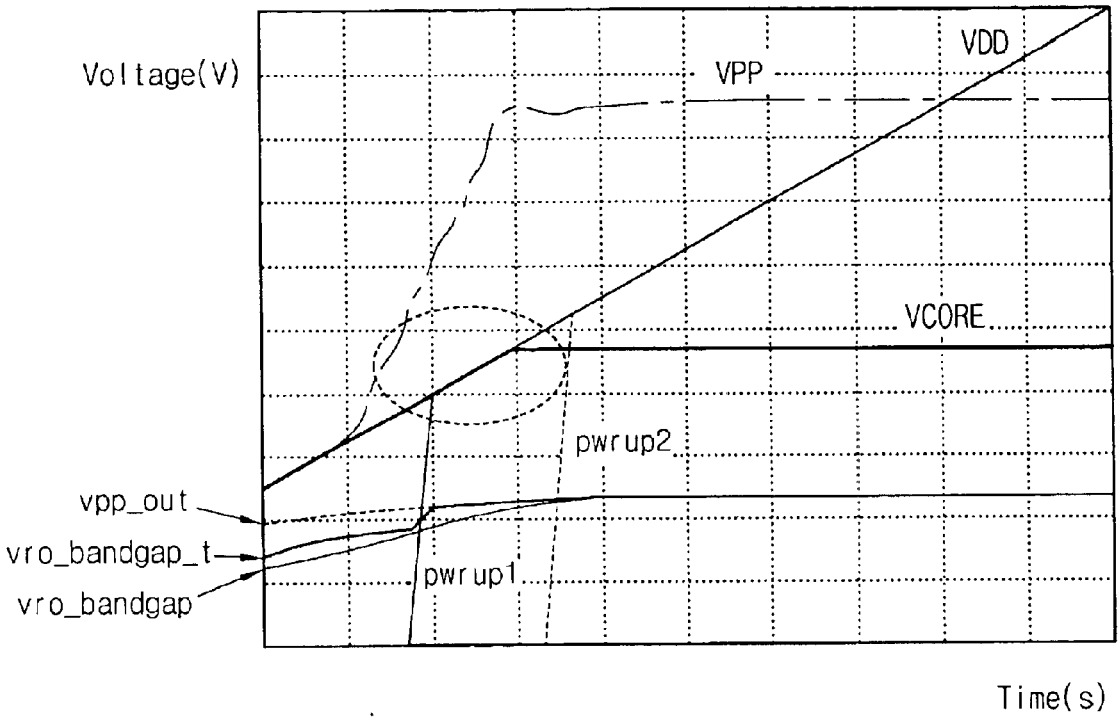
FIG. 6 illustrates a direct current voltage waveform of a core voltage generator according to an embodiment of the present invention.

The second switch 421 includes a transfer gate which is formed by a PMOS transistor PM22 and an NMOS transistor NM22. A turning on/off operation of the second switch 421 is controlled according to the output voltage pwrup2 of the second power up sensing circuit. As shown in FIG. 6, when the output voltage pwrup2 of the second power up sensing circuit is at a low level, the second switch 421 is turned off. When the output voltage pwrup2 of the second power up sensing circuit is at a high level, the second switch 421 is turned on. When the second switch 421 is turned on, a predetermined reference voltage vro_bandgap is transferred to an input terminal of the amplifier 430. A level of the reference voltage vro_bandgap is preferably a half of a core voltage VCORE. The core voltage VCORE is an internal which the amplifier 430 outputs. However, as shown in FIG. 5, after the external voltage VDD is applied to the amplifier 430, a level of the reference voltage vro_bandgap may be less than a half of a final core voltage VCORE for a predetermined time. The reason is that the reference voltage vro_bandgap is not normally supplied for a predetermined time after the external voltage VDD is applied to the amplifier 430. The reference voltage vro_bandgap is one of internal voltages which are used in a semiconductor memory device.

The amplifier 430 includes a differential amplfier. The amplifier 430 includes a current mirror, two NMOS transistors NM41 and NM42, an NMOS transistor NM43, a PMOS transistor PM43, and resistors R41 and R42. The current mirror has two PMOS transistors PM41 and PM42. The two NMOS transistors NM41 and NM42 receive an input signal. The NMOS transistor NM43 is a control transistor which flows a predetermined current into an output terminal of the amplifier 430. The PMOS transistor PM43 receives a voltage of a drain of the NMOS transistor NM41 through a gate thereof. The resistors R41 and R42 are connected between a drain of the PMOS transistor PM43 and a ground, and are connected to each other in series. Gates of the NMOS transistors NM41 and NM43 receive the signal vro_bandgap_t passed through the first and second switches 420 and 421. A source of the PMOS transistor PM43 is connected to the external voltage VDD. A middle node of the resistors R41 and R42 is connected to a gate of the NMOS transistor NM42. An output terminal of the amplifier 430 is a drain of the PMOS transistor PM43 and outputs a core voltage for an internal voltage. The amplifier 430 compares the signal (the voltage of a node a) applied to a gate of the NMOS transistor NM42 with the signal vro_bandgap_t applied to a gate of the NMOS transistor NM41, and controls a level of a voltage applied to a gate of the PMOS transistor PM43. Preferably, a level of the core voltage VCORE is designed to have twice a level of a signal applied to a gate of the NMOS transistor NM41. The amplifier 430 is one example of an amplifier. Those skilled in the art will embody a modified circuit having the same function as that of the amplifier 430.

Hereinafter, an operation of the core voltage generator will be described.

1) When the output voltages pwrup1 and pwrup2 of the first and second power up sensing circuits are all at low levels, a circuit of FIG. 3B is enabled according to the output voltage pwrup1 of the first power up sensing circuit of FIG. 3A. Accordingly, the core voltage VCORE depends on the external voltage. In the case, since both of the first and second switches 420 and 421 are turned off, the core voltage generator shown in FIG. 5 does not operate.

2) When the output voltage pwrup1 of the first power up sensing circuits is at a high level, but the output voltage pwrup2 of the second power up sensing circuit is at a low level, the first switch 420 is turned on. Accordingly, the output voltage VPP_OUT of the clamp circuit 400 is applied to a gate of the NMOS transistor NM41 of the amplifier 430. At this time, the output voltage VPP_OUT of the clamp circuit 400 is greater than a voltage of another input terminal (node a) of the amplifier 430. The reason is that a core voltage prior to applying the output voltage VPP_OUT of the clamp circuit 400 to to a gate of the NMOS transistor NM41 is identical with an external voltage VDD by an operation of the core voltage generator of FIG. 3B, and the external voltage VDD has still a low potential level as shown in FIG. 6. Since a voltage of the node (a) is {R42/(R41+R42)}*VCORE, the voltage of the node (a) is less than the output voltage VPP_OUT of the clamp circuit.

Accordingly, the PMOS transistor PM41 is turned on and a core voltage VCORE depends on the external voltage VDD (FIG. 6). The core voltage VCORE is an output voltage of the amplifier 430.

3) When the output voltages pwrup1 and pwrup2 of the first and second power up sensing circuits are all at high levels, the second switch 421 is turned on. Accordingly, the reference voltage vro_bandgap is applied to a gate of the NMOS transistor NM41 of the amplifier 430 through the second switch 421. When both of the output voltages pwrup1 and pwrup2 of the first and second power up sensing circuits become high levels, the potential level of the reference voltage vro_bandgap preferably becomes a half of a final core voltage VCORE.

As indicated above, the core voltage VCORE is designed to have twice a voltage of an input signal vro_bandgap_t. The reference voltage vro_bandgap applied to a gate of the NMOS transistor NM41 is compared with a voltage of the node (a). The voltage of the node (a) is {R42/(R41+R42)}*VCORE. When the reference voltage vro_bandgap is greater than the voltage of the node (a), the amplifier 430 outputs the core voltage VCORE having twice the reference voltage vro_bandgap. When the reference voltage vro_bandgap is less than the voltage of the node (a), since the PMOS transistor PM43 is turned off, the core voltage VCORE has an existing value. After a predetermined time lapses, the core voltage becomes less than the reference voltage vro_bandgap, the PMOS transistor PM43 is again turned on to increase the core voltage VCORE. Consequently, a final destination value of the core voltage VCORE changes within a predetermined range.

FIG. 6 illustrates a direct current voltage waveform of a core voltage generator according to an embodiment of the present invention.

Degradation of a core voltage according to the present invention generating from a change time of the output signal pwrup1 of the first power up sensing circuit to a high level to a change time of the output signal pwrup2 of the second power up sensing circuit to a high level is reduced more than that in the conventional core voltage generator. That is, the core voltage in a part indicated as a circle is stable.

Figure 2A:
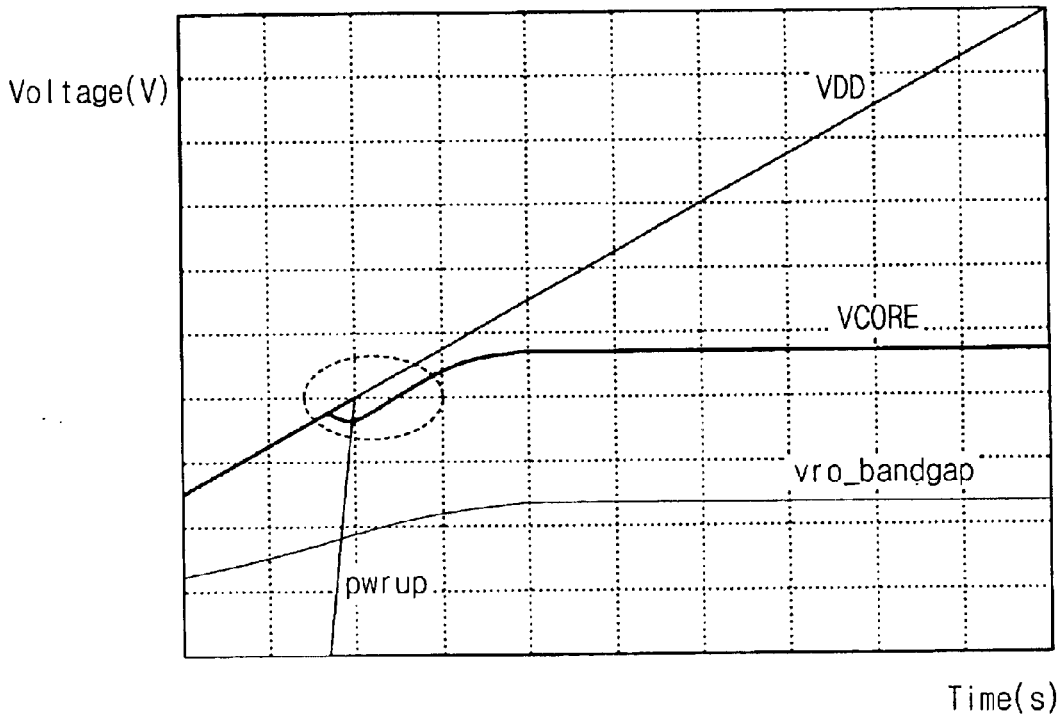
FIG.2A (RELATED ART)
FIG. 2A illustrates a direct current voltage waveform of the conventional circuits shown in FIGS. 1A, 1B and 1C.
Figure 2B:
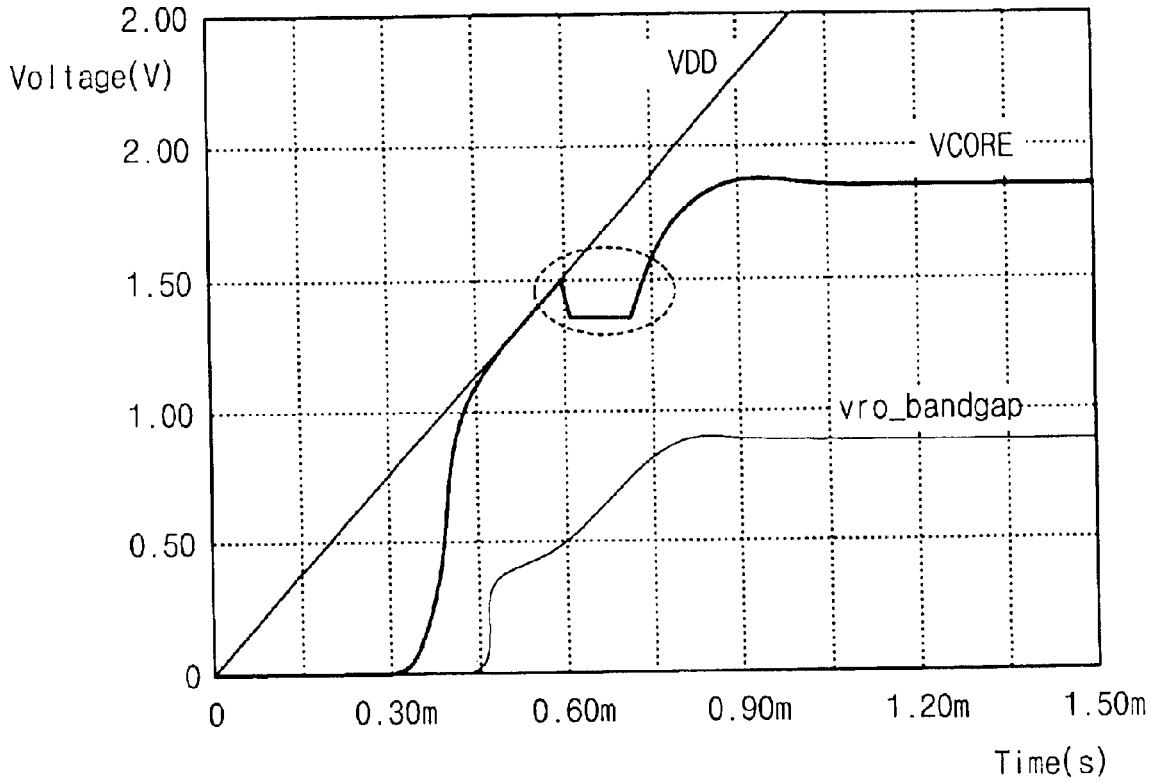
FIG.2B (RELATED ART)
FIG. 2B illustrates an alternating current voltage waveform of the circuits shown in FIGS. 1A, 1B and 1C.
Figure 7:
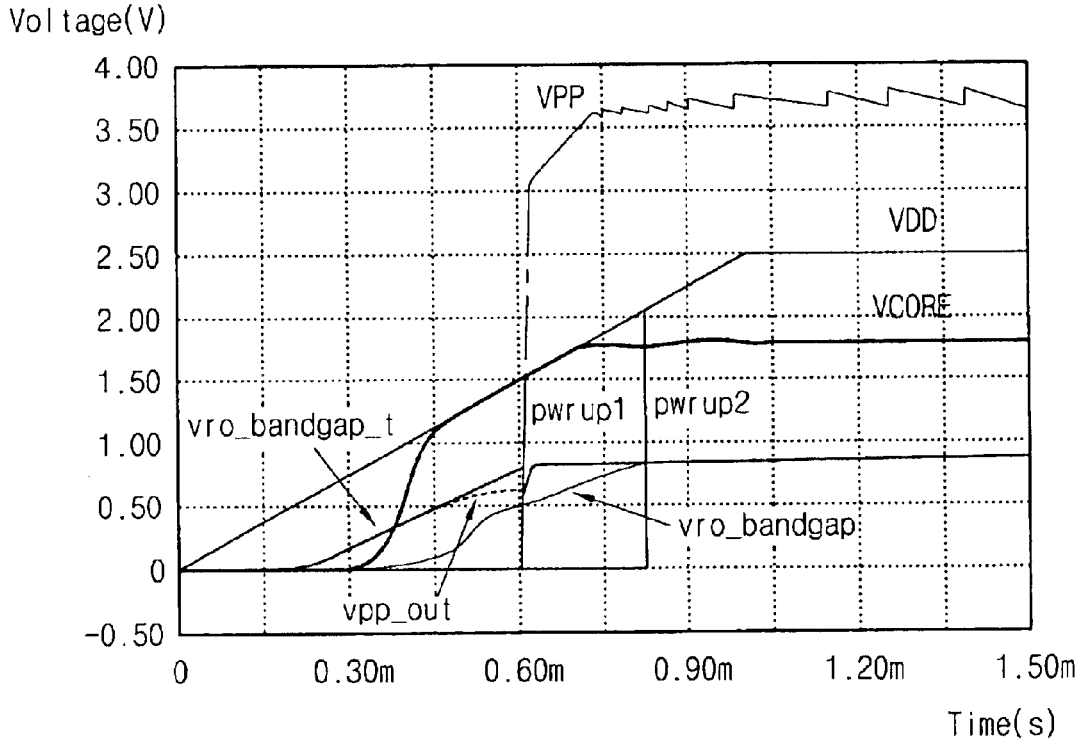
FIG. 7 illustrates an alternating current voltage waveform of a core voltage generator according to an embodiment of the present invention.

FIG. 7 illustrates an alternating current voltage waveform of a core voltage generator according to an embodiment of the present invention. The alternating current voltage waveform of the core voltage generator is different from the direct current voltage waveform of the conventional circuit of FIG. 2B. Although the external voltage VDD changes, a core voltage VCORE is stable. The core voltage VCORE is an internal voltage.

As shown in FIG. 7, when both of the control signals pwrup1 and pwrup2 are at low levels, a potential level of the voltage VCORE is approximately double than that of the voltage VPP_OUT or the voltage vro_bandgap.

As mentioned above, although the external voltage changes, a stable internal voltage without degradation is supplied. Accordingly, the internal voltage generator according to the present invention normally operates a semiconductor device.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An internal voltage generator for a semiconductor device for receiving first through third control signals and generating an internal voltage used in the semiconductor device when an external voltage is applied to the internal voltage generator, wherein:

the internal voltage used in the semiconductor device is a first voltage until a first control signal becomes equal to the external voltage applied to the semiconductor device;

the internal voltage used in the semiconductor device is a second voltage until a second control voltage becomes equal to the external voltage after the first control signal becomes equal to the external voltage;

the internal voltage used in the semiconductor is a third voltage after both of the first and second control signals become equal to the external voltage; and the first voltage is less than the second voltage and the second voltage is less than or equal to the third voltage.

2. An internal voltage generator according to claim 1, wherein the first voltage has a voltage level following a level of the external voltage, and a level of the third voltage is fixed.

3. An internal voltage generator for receiving an external voltage and outputting an internal voltage, the internal voltage generator comprising:

a clamp means for outputting a first voltage;

first and second power up sensing means for sensing the external applied to the semiconductor device and outputting first and second control signals, respectively;

a first switch for receiving the first voltage;

a switch controller for receiving the first and second control signals from the first and second power up sensing means and controlling turn on/off of the first switch;

a second switch being turned on/off according to the second control signal from the second power up sensing means for receiving a second voltage; and an amplifier for selectively receiving the first and second voltages from the first and second switches and outputting the second voltage.

4. An internal voltage generator according to claim 3, wherein, when the external voltage is applied to the semiconductor device, a first time period which it takes while a signal level of the first control signal changes from a low level to a high level is smaller than a second time period which it takes while a signal level of the second control signal changes from a high level to a low level, the first control signal being an output signal of the first power up sensing means, the second control signal being an output signal of the second power up sensing means.

5. An internal voltage generator according to claim 4, wherein:

when both of the first and second control signals are at low levels, the first and second switches are turned off and the internal voltage is the external voltage supplied through a MOS transistor which is enabled according to the first control signal;

when the first control signal is at a high level and the second control signal is at a low level, the first switch is turned on and the second switch is turned off, and the internal voltage is a signal obtained by amplifying the first voltage applied to the first switch through the first switch; and when the first and second control signals are at high levels, the first switch is turned off and the second switch is turned on, and the internal voltage is a signal obtained by amplifying the second voltage applied to the amplifier through the second switch.

6. An internal voltage generator according to claim 3, wherein:

both of the first voltage and the second voltage are reference voltages;

the third voltage is the internal voltage from the internal voltage generator; and when both of the first and second control signals are at low levels, a potential level of the third voltage is approximately double than that of the first voltage or the second voltage.

* * * * *